US007743531B2

(12) United States Patent
Aveni et al.

(10) Patent No.: US 7,743,531 B2
(45) Date of Patent: Jun. 29, 2010

(54) ARTICLE OF FOOTWEAR WITH EXPANDABLE HEEL PORTION

(75) Inventors: Michael A. Aveni, Lake Oswego, OR (US); Steven C. McDonald, Heber, UT (US)

(73) Assignee: Nike, Inc., Beaverton, OR (US)

( * ) Notice: Subject to any disclaimer, the term of this patent is extended or adjusted under 35 U.S.C. 154(b) by 813 days.

(21) Appl. No.: 11/613,951

(22) Filed: Dec. 20, 2006

(65) Prior Publication Data

US 2008/0148600 A1 Jun. 26, 2008

(51) Int. Cl.
*A43B 21/10* (2006.01)
*A43B 11/00* (2006.01)

(52) U.S. Cl. ..... 36/105; 36/138; 36/51; 36/72 B; 36/56

(58) Field of Classification Search ..... 36/105, 36/138, 51, 72 B, 56, 99, 50.1, 97
See application file for complete search history.

(56) References Cited

U.S. PATENT DOCUMENTS

| | | | | | |
|---|---|---|---|---|---|
| 208,897 | A * | 10/1878 | Emerson | 36/47 |
| 236,323 | A * | 1/1881 | Graf | 36/51 |
| 330,176 | A * | 11/1885 | Walker | 36/51 |
| 378,988 | A * | 3/1888 | Warren | 36/51 |
| 380,715 | A * | 4/1888 | Furber | 36/51 |
| 586,137 | A | 7/1897 | Medger | |
| 621,922 | A | 3/1899 | Kelsall | |
| 1,515,086 | A * | 11/1924 | Baluta | 36/1 |
| 1,600,621 | A | 9/1926 | Buek, Jr. | |
| 1,617,430 | A | 2/1927 | Wolfelt | |
| 1,663,319 | A | 3/1928 | Snell | |
| 1,832,691 | A | 11/1931 | David | |
| 1,864,254 | A | 6/1932 | Meyer | |
| 2,161,472 | A | 6/1939 | Hurwit | |
| 2,240,626 | A | 5/1941 | Ochs | |
| 3,538,628 | A | 11/1970 | Einstein, Jr. | |
| 3,693,269 | A | 9/1972 | Guarrera | |
| 4,023,283 | A * | 5/1977 | Pfander | 36/11 |
| 4,608,769 | A * | 9/1986 | Sturlaugson | 36/68 |
| 5,088,166 | A | 2/1992 | Lavinio | |
| 5,090,140 | A * | 2/1992 | Sessa | 36/138 |
| 6,442,874 | B1 * | 9/2002 | Long | 36/97 |
| 6,880,272 | B2 * | 4/2005 | Wells | 36/138 |
| 7,204,042 | B2 * | 4/2007 | Aveni | 36/50.1 |
| 2003/0106170 | A1 * | 6/2003 | Issler | 12/142 C |
| 2005/0284002 | A1 * | 12/2005 | Aveni | 36/50.1 |
| 2008/0083137 | A1 * | 4/2008 | Aveni | 36/88 |

* cited by examiner

*Primary Examiner*—Ted Kavanaugh
(74) *Attorney, Agent, or Firm*—Plumsea Law Group, LLC

(57) ABSTRACT

An article of footwear with heel webbing is disclosed. The article of footwear includes an elastic member along a heel portion. The elastic member is associated with a heel protector. The heel protector is attached to the outsole of the article of footwear at one end and to a portion of the elastic member at another end.

20 Claims, 5 Drawing Sheets

ARTICLE OF FOOTWEAR WITH EXPANDABLE HEEL PORTION

BACKGROUND OF THE INVENTION

1. Field of the Invention

The present invention relates generally to articles of footwear and in particular to articles of footwear with heel webbing.

2. Description of Related Art

Woven articles of footwear have been previously proposed. Aveni (U.S. patent number 2005/0284002), the entirety of which is incorporated by reference, discloses an article of footwear and a method of making it where a woven region is integrated with a lacing system. In particular, Aveni teaches an upper with one or more woven regions. A first woven region may be located in the vamp region while a second woven region may be located in the heel region.

Aveni teaches woven regions that are formed from a single elongated strand element. In some cases, the weaving material may be made from a material with elastic properties. In some cases, a rubberized membrane may be used instead. Also disclosed, are leather strands, nylon webbing or other synthetic webbing.

Articles of footwear with lacing systems closing at the have also been disclosed. Paul (U.S. Pat. No. 1,184,123) discloses an adjustable slipper. This slipper includes lacing holes along the rear of the slipper, the rear of the slipper being divided or cut open. Additionally a lacing string is attached to the rear of the slipper and disposed through the lacing holes. The slipper also includes a tongue along the heel.

Ferry (U.S. patent number) also discloses an article of footwear with a portion of a lacing system disposed along the heel portion. In particular, the article of footwear disclosed is a boot having lacing that extends over an opening along the upper front and using a plurality of metallic rings extending in vertical lines adjacent to the back ankle section to provide additional support to the rear of the wearer's boot.

While the prior art teaches articles of footwear with heel webbing and lacing systems disposed along the heel of the footwear, related designs have many shortcomings. The heel webbing disclosed by Aveni is not intended to be the primary system for tightening the footwear to a user's foot. Instead Aveni's design requires an additional lacing system disposed along the front of the upper. Furthermore, Aveni does not include a tab disposed between the heel and a user's foot. The remaining art teaches a traditional lacing system dispose along the rear of the footwear, but does not teach a webbing system of any kind. Additionally, while Paul does teach a tongue, the tongue taught by Paul does not connect directly to the lacing system disclosed.

There is a need in the art for an article of footwear including heel webbing configured to secure an article of footwear to the user's foot without the necessity of an additional lacing system along the front. Furthermore, there is a need for an article of footwear with a heel protector that is connected to a tightening system disposed along the heel of the footwear.

SUMMARY OF THE INVENTION

An article of footwear with heel webbing is disclosed. In one aspect, the invention provides an article of footwear including an upper, comprising: a heel portion including a heel protector; an elastic member disposed across a cutout portion of the heel portion; and where the tab portion folds over a portion of the elastic member.

In another aspect, the elastic member is an elastic lace.

In another aspect, the elastic lace is woven across the cutout portion.

In another aspect, the weave is a plain weave.

In another aspect, the cutout portion has a circular shape.

In another aspect, a first end of the heel protector is attached to an outsole.

In another aspect, the invention provides an article of footwear including an upper, comprising: a heel portion including a heel protector; the heel protector including a first hole and a second hole an elastic member disposed along a cutout portion of the heel portion; and where a portion of the elastic member is disposed through the first hole and the second hole of the heel protector.

In another aspect, the cutout portion has a circular shape.

In another aspect, the portion of the elastic member is a loop.

In another aspect, a first end of the heel protector is associated with an outsole.

In another aspect, the first end is attached to the outsole by stitching.

In another aspect, the elastic member is an elastic lace.

In another aspect, the elastic lace is woven.

In another aspect, the invention provides an article of footwear including an upper, comprising: a heel portion including an elastic member disposed over a cutout portion of the heel portion; a heel protector associated with an inner side of the heel portion; a first end of the heel protector associated with an outsole; and where a second end of the heel protector is associated with a portion of the elastic member.

In another aspect, the cutout portion has a circular shape.

In another aspect, the elastic member is an elastic lace.

In another aspect, the elastic lace is woven.

In another aspect, the weave of the elastic lace is a diamond weave.

In another aspect, the first end of the heel protector is attached to the outsole.

In another aspect, the attachment is accomplished via stitching.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
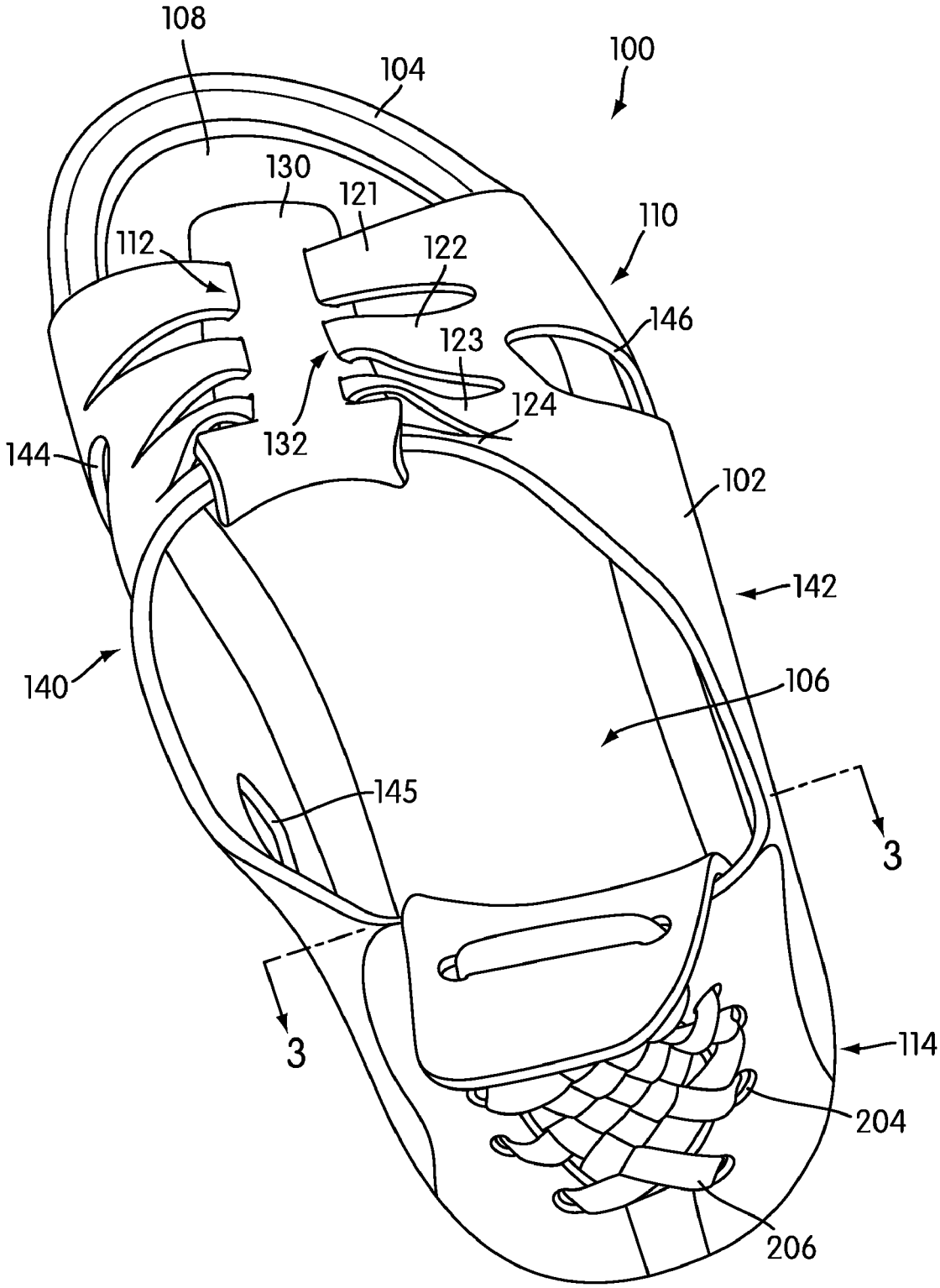
FIG. 1 is an isometric view of a preferred embodiment of an article of footwear with heel webbing.

FIG. 1 is a preferred embodiment of article of footwear 100. For clarity, the following detailed description discusses a preferred embodiment, however, it should be kept in mind that the present invention could also take the form of any other kind of footwear including, for example, skates, boots, ski boots, snowboarding boots, cycling shoes, athletic shoes, or any other kind of footwear.

Article of footwear 100 preferably includes outsole 104. In some embodiments, outsole 104 may be configured to contact a user's foot along first side 108. Preferably, a second side 103 (see FIG. 3) is configured to contact the ground or other surfaces. Outsole 104 may include a variety of different tread patterns and/or cleats depending on the intended application.

Outsole 104 may be preferably associated with upper 102. In some embodiments, outsole 104 may be attached to upper 102. In some embodiments, outsole 104 may be attached to upper 102 by an adhesive of some kind. Preferably, however, outsole 104 may be attached to upper 102 by stitching.

In a preferred embodiment, upper 102 may be constructed of leather. However, it should be kept in mind that upper 102 may also be constructed of other materials, including, but not limited to, fabrics, synthetic fabrics, as well as other kinds of materials. Additionally, upper 102 may be constructed as a single piece or as multiple pieces that are attached to one another during manufacturing.

Preferably, upper 102 includes provisions for allowing a user's foot to be inserted. In some embodiments, upper 102 may include entry region 106. In a preferred embodiment, entry region 106 may be an opening in upper 102. Generally, the size of entry region 106 may be varied.

Generally, upper 102 may include a provision that allows a user's forefoot to be secured in place once the forefoot has been inserted. In some embodiments, article of footwear 100 may include forefoot portion 110. Forefoot portion 110 is preferably associated with a user's forefoot. Additionally, article of footwear 100 preferably includes heel portion 114. In some embodiments, heel portion 114 may be associated with a user's heel.

In some embodiments, forefoot portion 110 may include vamp portion 112. In some embodiments, vamp portion 112 may be associated with the top of a user's foot. Preferably, vamp portion 112 may be configured to contact the top of a user's foot. In some embodiments, vamp portion 112 may include one or more straps. In a preferred embodiment, vamp portion 112 includes first strap 121, second strap 122, third strap 123 and fourth strap 124.

Preferably, straps 121-124 are associated with forefoot tab 130. In particular, straps 121-124 may be disposed through slots 132 disposed along forefoot tab 130. In some embodiments, forefoot tab 130 may provide structure to straps 121-124 of vamp portion 112. Also, in some embodiments, forefoot tab 130 may be configured to provide cushioning between vamp portion 112 and the top of a user's foot.

In some embodiments, upper 102 may include holes disposed along medial side 140 and/or lateral side 142. In some embodiments, medial side 140 may include first hole 144 and second hole 145. Additionally, lateral side 142 may include third hole 146 and fourth hole 147 (see FIG. 2). Preferably, fourth hole 147 may be disposed adjacent to second hole 145. Generally, the sizes of holes 144-147 may be varied.

Preferably, article of footwear 100 includes provisions for tightening or securing upper 102 around a user's foot. In some embodiments, this may include a fastening system disposed along the heel portion of upper 102. In a preferred embodiment, the fastening system may include heel webbing.

Figure 2:
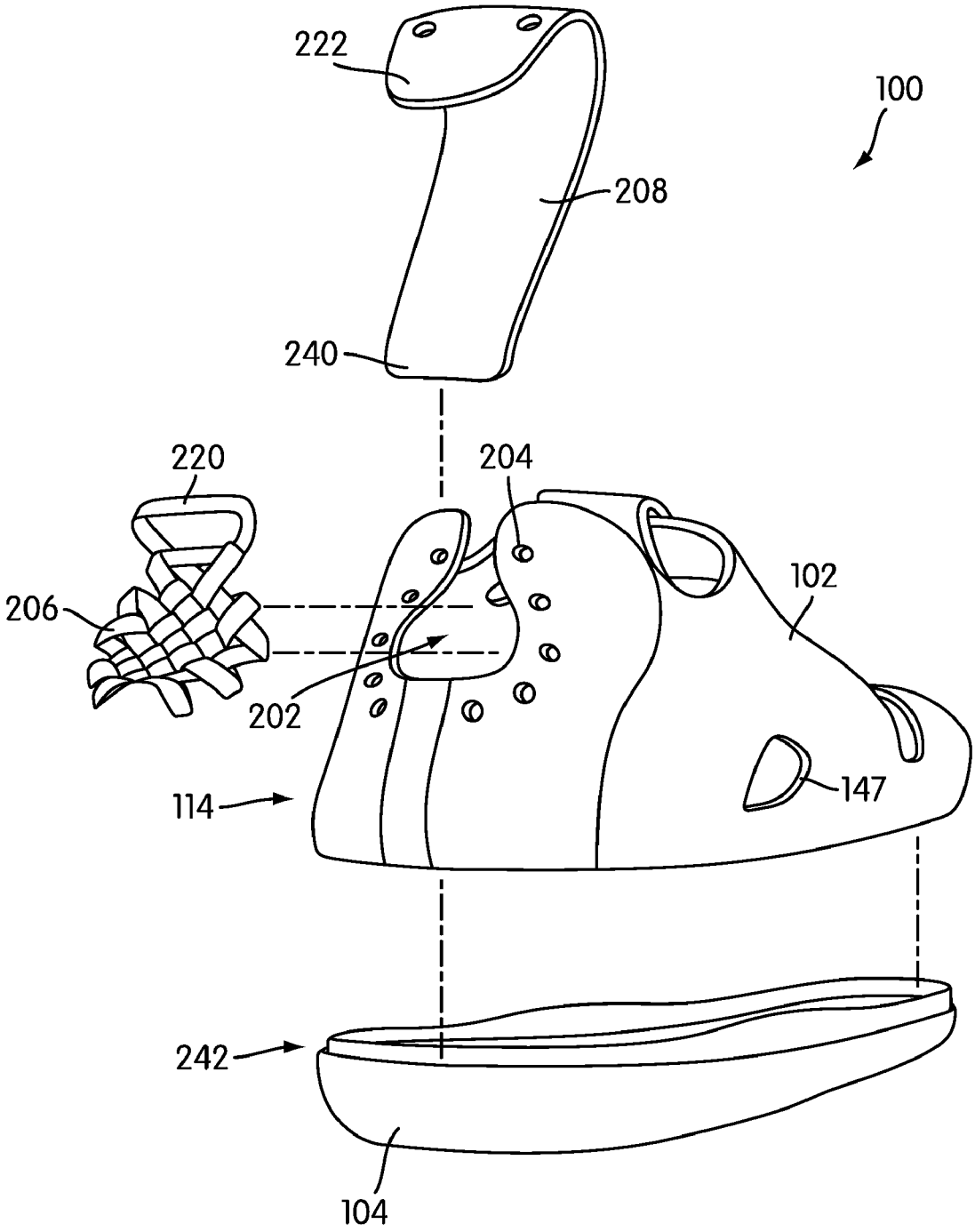
FIG. 2 is an exploded isometric view of a preferred embodiment of an article of footwear with heel webbing.

Referring to FIGS. 1 and 2, heel portion 114 of upper 102 preferably includes cutout portion 202. In some embodiments, cutout portion 202 may be rounded in shape. Preferably, cutout portion 202 may be associated with small holes 204. In a preferred embodiment, small holes 204 are disposed around the perimeter of cutout portion 202. In this embodiment, the number of holes comprising small holes 204 is 10, but in other embodiments this number may vary.

Preferably, heel portion 114 of upper 102 may also include heel webbing 206. In a preferred embodiment, heel webbing 206 may comprise a single elastic lace that is inserted through small holes 204 and is disposed across cutout portion 202. In this manner, heel webbing 206 may be comprised of a single lace that is woven across cutout portion 202. This weaving pattern may be any kind of weave, including, but not limited to, a basket weave, a ribbed weave, a satin weave, a pile weave, as well as other kinds of weaves. In a preferred embodiment, heel webbing 206 may be woven as a plain weave. In some embodiments, heel webbing 206 may be rotated. In a preferred embodiment, the weave geometry of heel webbing 206 may be rotated about 45 degreed from the vertical. This can result in a weave with warp strands extending at about 45 degrees from vertical, and weft strands extending at about 45 degrees from vertical. In other embodiments, the weave geometry can be rotated to assume different angular positions.

In some embodiments, more than one strand may be used to form heel webbing 206. The hand labor involved in constructing woven products generally requires more time and can increase the production costs. Because of this, it is often desirable to determine an optimal length to weave at one time. The longer the strand, the longer it takes to weave. Longer strands require pulling the extra webbing through each stitch. Shorter strands are less time consuming to weave, and can therefore require less labor expense. But using more than one strand requires that each strand be ended.

If more than one strand is used, the strands are preferably connected prior to being woven. In such an event, the ends of strands of weaving material are preferably knotted together or attached with any suitable adhesive material. Other known methods of attaching the strands of weaving material include physical attachment with any of variety of adhesives, physical attachment with any of variety of mechanical attaching components such as tacks, nails, bards and other similar devices, physical attachment via manipulation of the physical properties of the weaving material by heat, cold, radiation, and/or exposure to different wavelengths of light and/or sound, or combinations of any of the above. In another arrangement, the ends of the strands are woven together as a connection device. To accomplish this, an extra layer of weaving at the connection point may be performed, and such avoids the need for an adhesive.

Heel webbing 206 may be attached to upper 102 using a variety of methods. In some embodiments, various ends of a lace comprising heel webbing 206 may be tied around one or more of small holes 204. In another embodiment, the ends of any laces comprising heel webbing 206 may be tied to one another, once the lace ends have been inserted through small holes 204. In other embodiments, portions of heel webbing 206 may be attached to upper 102 via an adhesive of some kind. Additionally, any of the methods described to attach the ends of the strands may be used to attach the strand or strands s to upper 102.

Generally, the strands can be attached to other strands or upper 102 by many different methods. The most common are; knotting, sewing and cementing. The following designations may be used for connecting the ends of the webbing (or lace) to itself or some other portion of article 100; physical connection (for example, knot, stitch, sewing or some kind of mechanical fastener), chemical (for example, cement, glue or welding) and other suitable methods.

It should be understood that heel webbing 206 may take a form other than a single elastic lace. In other words, heel webbing 206 may be replaced with a different kind of structure. In some embodiments, heel webbing 206 may comprise a single membrane that may be stretched across cutout portion 202. In some embodiments, this membrane may be an elastic material that does not have visible holes. In other embodiments, this membrane may be another type of webbing, including, but not limited to nylon webbing as well as other types of synthetic webbing. In other embodiments, heel webbing 206 may comprise a single lace that is inelastic, but loose, allowing heel portion 114 to expand. Also, in some embodiments, heel webbing 206 may comprise two or more laces, rather than just a single lace.

Preferably, and analogous to a traditional upper including a lacing system along the vamp region, upper 102 may include provisions for protecting a user's heel from the uneven surface of heel portion 114, which includes cutout portion 202 and heel webbing 206. In some embodiments, upper 102 may include a heel protector of some kind. This heel protector may be analogous to a tongue that may be disposed between a user's foot and a vamp portion of an upper in a traditional design. Preferably, the heel protector also includes provisions for helping to adjust heel webbing 206.

In some embodiments, upper 102 may include heel protector 208. In some embodiments, heel protector 208 may be associated with heel portion 114. In particular, heel protector 208 may be disposed adjacent to heel portion 114. In a preferred embodiment, heel protector 208 may be disposed between heel portion 114 of upper 102 and a user's foot. In other words, heel protector 208 may be preferably disposed within upper 102.

In some embodiments, heel protector 208 may be constructed of a similar material as upper 102. Generally, heel protector 208 may be constructed of any of the kinds of materials described previously that may be used in the construction of upper 102. These include leathers, fabrics, synthetic fabrics, as well as other kinds of materials.

Figure 3:
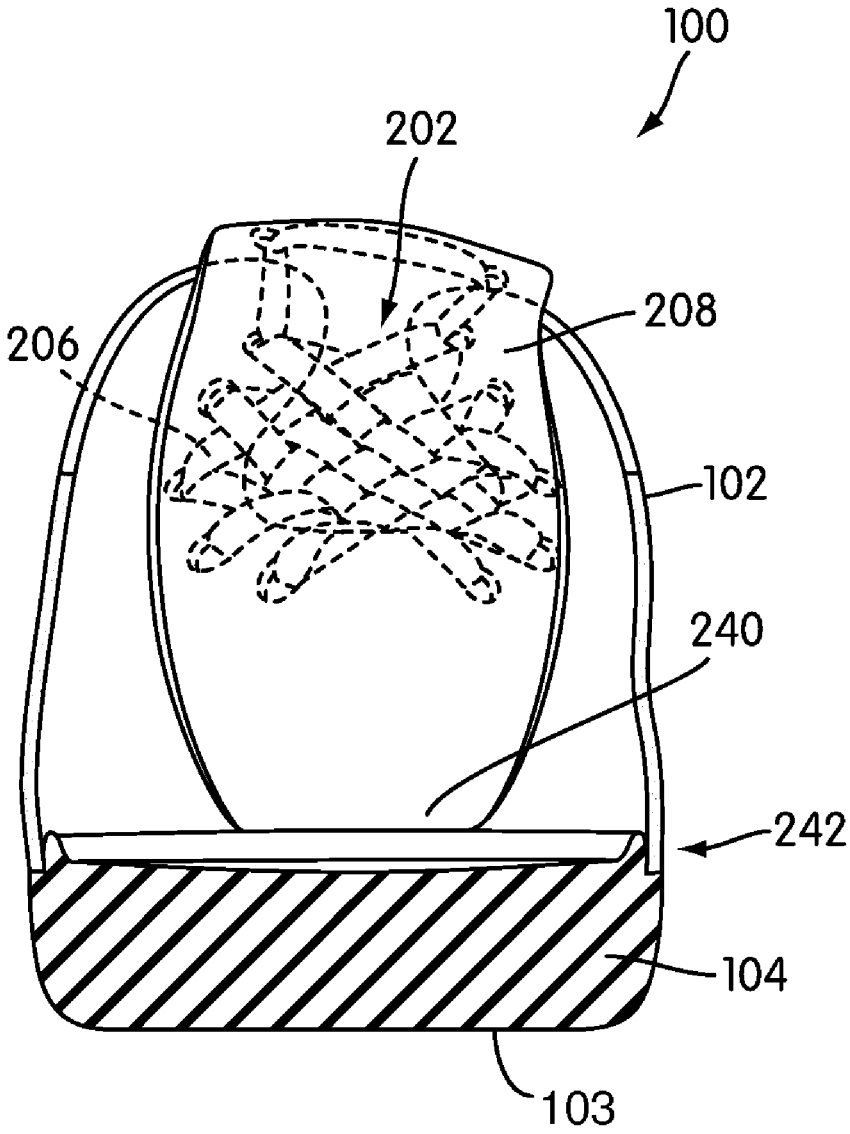
FIG. 3 is a cross section view of a preferred embodiment of an article of footwear with a heel protector.

Referring to FIGS. 2 and 3, first end 240 of heel protector 208 may be associated with outsole 104. Preferably, first end 240 may be associated with heel region 242 of outsole 104. In some embodiments, first end 240 of heel protector 208 may be attached to heel region 242 of outsole 104. In a preferred embodiment, first end 240 may be stitched to heel region 242 of outsole 104.

With this configuration, heel protector 208 preferably provides cushioning between a user's foot and heel webbing 206 (shown in FIG. 3 in phantom behind heel protector 208). Heel protector 208 also preferably prevents a user's foot heel from contacting cutout portion 202 directly. Using this configuration, heel protector 208 preferably decreases the amount of undesired friction caused by heel webbing 206 and cutout portion 202 in contact with a user's heel. This may reduce the tendency of a user's heel to be irritated or prevent the development of blisters.

Figure 4:
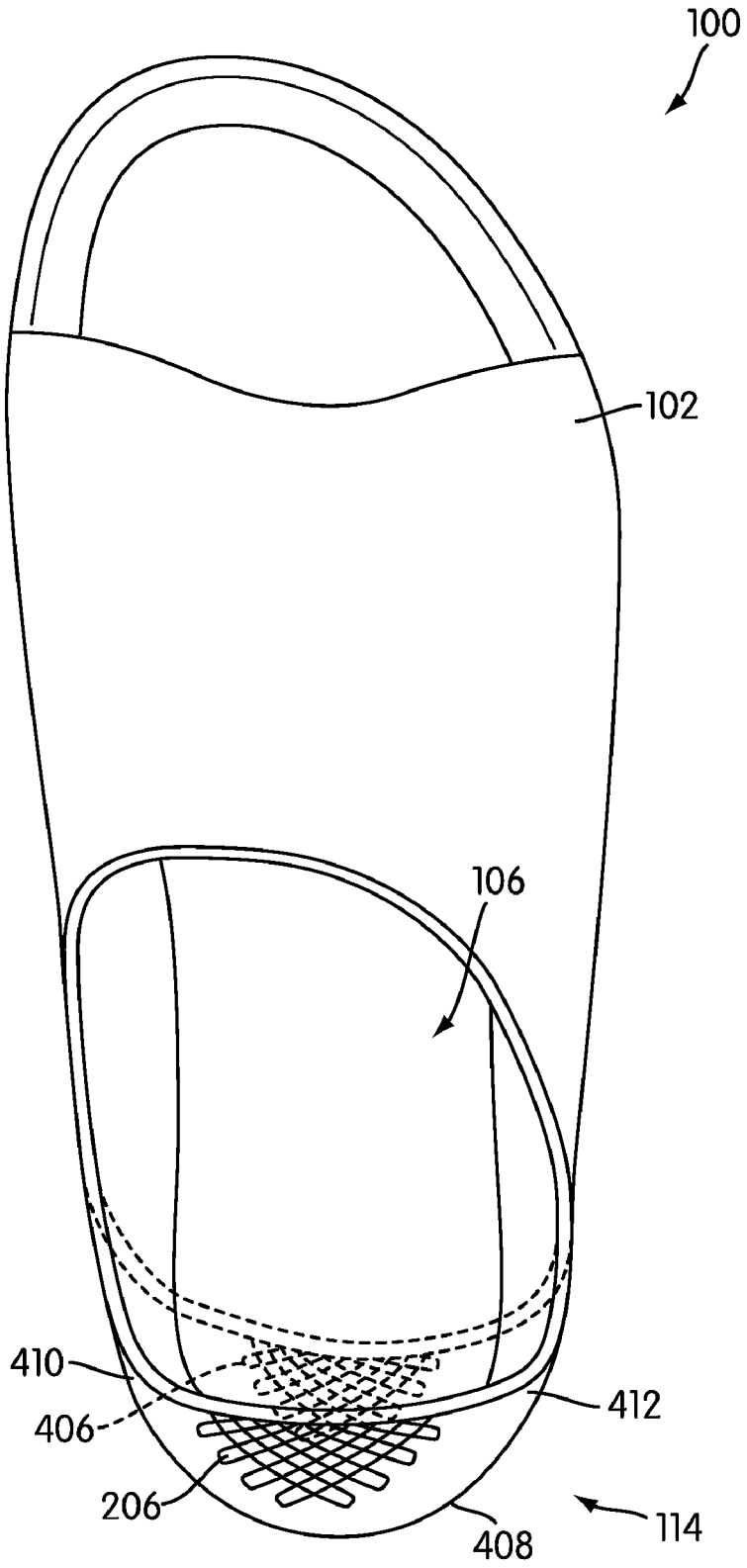
FIG. 4 is a schematic plan view of a preferred embodiment of an article of footwear.

Referring to FIG. 4, upper 102 preferably includes provisions for facilitating the expansion of entry region 106. In some embodiments, heel portion 114 may be expanded to allow a user's foot to be inserted into article of footwear 100. Specifically, medial heel portion 410 and lateral heel portion 412 may be pulled apart, as heel webbing 206 is preferably expandable. As medial heel portion 410 and lateral heel portion 412 are extended, heel portion 114 preferably expands from first position 406 (shown in FIG. 4 in phantom) to open position 408. In this manner, as heel portion 114 expands and is translated rearward and opened outward, the size of entry region 106 may increase. This preferably allows the user to insert their foot more easily. For the purposes of illustration, the size of enlarged entry region 408 has been exaggerated in FIG. 4.

As medial heel portion 410 and lateral heel portion 412 are released, heel webbing 206 preferably contracts, allowing entry region upper 102 to close gently around a user's foot. In particular, heel webbing 206 preferably applies tension along heel portion 114, allowing article of footwear 100 to be tightened to a user's foot. In this manner, the tightening of upper 102 around a user's foot at heel portion 114 is preferably similar to the way an upper may be tightened to the top of a user's foot using a lacing system in a traditional upper design.

In some embodiments, heel protector 208 may be associated with heel webbing 206. In a preferred embodiment, heel protector 208 may be attached to heel webbing 206. In this manner, heel protector 208 may be used to slightly adjust heel webbing 206 in some cases.

Figure 5:
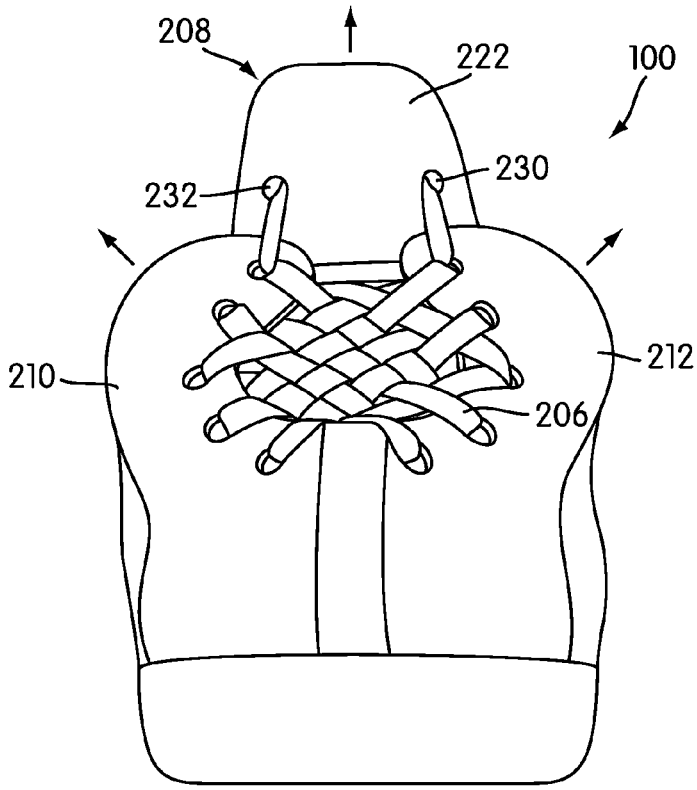
FIG. 5 is a rear view of a preferred embodiment of an article of footwear with heel webbing.
Figure 6:
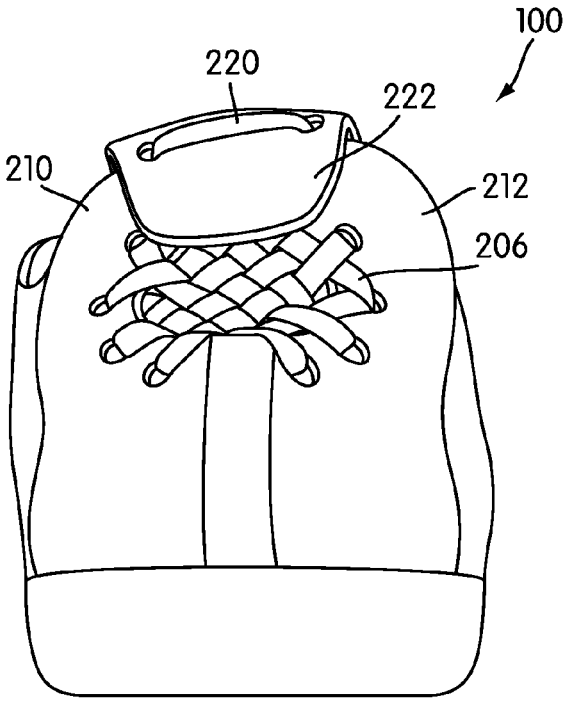
FIG. 6 is a rear view of a preferred embodiment of an article of footwear with heel webbing.

Referring to FIGS. 5 and 6, heel protector 208 may be associated with heel webbing 206. In particular, folding portion 222 of heel protector 208 may be associated with heel webbing 206. In some embodiments, folding portion 222 of heel protector 208 may be associated with upper portion 220 of heel webbing 206. In some embodiments, upper portion 220 may be a loop. In a preferred embodiment, upper portion 220 of heel webbing 206 may be disposed through first tab hole 230 and second tab hole 232 of folding portion 222.

In some embodiments, folding portion 222 may be pulled taught into a vertical position, as seen in FIG. 5. By doing this, the user may hold folding portion 222 as they insert their foot into article of footwear 100. This can help ease entry of the foot, like a shoe horn. In some cases, medial heel portion 410 and lateral heel portion 412 may expand slightly under the tension applied to heel portion 114 by heel protector 208.

Once folding portion 222 of heel protector 208 is released, upper portion 220 preferably applies tension along folding portion 222. Under this tension, folding portion 222 may return to its initial position, as seen in FIG. 6. In a similar manner, medial heel portion 410 and lateral heel portion 412 may be disposed in their initial positions.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

We claim:

1. An article of footwear including an upper, comprising:

a heel portion including an interior face, an exterior face opposite to the interior face, and an edge between the interior face and the exterior face at an entry region of the upper;

a heel protector including an interior portion and a tab portion;

an elastic member disposed across a cutout portion of the heel portion;

wherein the interior portion of the heel protector is disposed inside the upper and adjacent to the interior face of the heel portion;

wherein the heel protector folds around the edge of the heel portion such that the tab portion is disposed over a portion of the elastic member; and wherein the tab portion of the heel protector is coupled to the heel portion by an elastic coupling so that, in an initial resting condition, the tab portion is held over the exterior face of the heel portion in a first folded configuration with respect to the interior portion;

wherein the elastic coupling stretches upon application of a pulling force to the tab portion to enable the tab portion to temporarily move away from the exterior face of the heel portion and to enable the tab portion of the heel protector to temporarily assume a second extended configuration with respect to the interior portion; and wherein, upon removal of the pulling force, the tab portion returns to the first folded configuration of the initial resting condition.

2. The article of footwear according to claim 1, wherein the elastic member is an elastic lace, and wherein the elastic coupling comprises a portion of the elastic lace.

3. The article of footwear according to claim 2, wherein the elastic lace is woven across the cutout portion.

4. The article of footwear according to claim 3, wherein the weave is a plain weave.

5. The article of footwear according to claim 1, wherein the cutout portion has a circular shape.

6. The article of footwear according to claim 1, wherein a first end of the heel protector is attached to an outsole, and wherein the heel protector is attached to the upper only by the elastic coupling.

7. An article of footwear including an upper, comprising:

a heel portion including an interior face, an exterior face opposite to the interior face, and an edge between the interior face and the exterior face at an entry region of the upper;

a heel protector including an interior portion and a tab portion;

the heel protector including a first hole and a second hole in the tab portion;

an elastic member disposed along a cutout portion of the heel portion;

wherein the interior portion of the heel protector is disposed inside the upper and adjacent to the interior face of the heel portion;

wherein the heel protector folds around the edge of the heel portion such that the tab portion is disposed over the exterior face of the heel portion;

wherein a portion of the elastic member is disposed through the first hole and the second hole of the heel protector;

wherein the elastic member elastically couples the heel protector to the heel portion so that, in an initial resting condition, the tab portion is held over the exterior face of the heel portion in a first folded configuration with respect to the interior portion;

wherein the elastic member stretches upon application of a pulling force to the tab portion to enable the tab portion to temporarily move away from the exterior face of the heel portion and to enable the heel protector to temporarily assume a second extended configuration with respect to the interior portion; and wherein, upon removal of the pulling force, the tab portion returns to the first folded configuration of the initial resting condition.

8. The article of footwear according to claim 7, wherein the cutout portion has a circular shape.

9. The article of footwear according to claim 7, wherein the portion of the elastic member is a loop.

10. The article of footwear according to claim 7, wherein a first end of the heel protector is associated with an outsole, and wherein the heel protector is attached to the user only by the elastic member.

11. The article of footwear according to claim 10, wherein the first end is attached to the outsole by stitching.

12. The article of footwear according to claim 7, wherein the elastic member is an elastic lace.

13. The article of footwear according to claim 12, wherein the elastic lace is woven.

14. An article of footwear including an upper, comprising:

a heel portion including an elastic member disposed over a cutout portion of the heel portion, wherein the heel portion includes an inner side, an outer side opposite to the inner side, and an edge between the inner side and the outer side;

a heel protector associated with the inner side of the heel portion;

a first end of the heel protector disposed inside the upper and associated with an outsole; and wherein the heel protector folds around the edge of the heel portion such that a second end of the heel protector is disposed over the outer side of the heel portion, wherein the second end is attached to a coupling portion of the elastic member, wherein the coupling portion elastically couples the second end of the heel protector to the heel portion so that, in an initial resting condition, the second end of the heel protector is held over the outer side of heel portion in a first folded configuration with respect to the first end; and wherein the coupling portion stretches upon application of a pulling force to the second end to enable the second end to temporarily move away from the outer side of the heel portion and to enable the second end to temporarily assume a second extended configuration with respect to the first end; and wherein, upon removal of the pulling force, the second end returns to the first folded configuration of the initial resting condition.

15. The article of footwear according to claim 14, wherein the cutout portion has a circular shape.

16. The article of footwear according to claim 14, wherein the elastic member is an elastic lace.

17. The article of footwear according to claim 16, wherein the elastic lace is woven.

18. The article of footwear according to claim 17, wherein the weave of the elastic lace is a diamond weave.

19. The article of footwear according to claim 14, wherein the first end of the heel protector is attached to the outsole, and wherein the heel protector is attached to the upper only by the coupling portion.

20. The article of footwear according to claim 19, wherein the first end of the heel protector is attached to the outsole by stitching.

* * * * *